United States Patent [19]

Swartz et al.

[11] 4,375,358

[45] Mar. 1, 1983

[54] FUEL SLURRIES OF SOLID CARBONACEOUS MATERIAL IN WATER

[75] Inventors: Charles J. Swartz; William P. Scott, both of Ponca City, Okla.

[73] Assignee: Conoco Inc., Ponca City, Okla.

[21] Appl. No.: 183,525

[22] Filed: Sep. 2, 1980

[51] Int. Cl.[3] ..... C10L 1/32

[52] U.S. Cl. ..... 44/51; 406/47; 406/49; 406/197

[58] Field of Search ..... 44/51; 406/47, 49, 197; 252/316

[56] References Cited

U.S. PATENT DOCUMENTS

| | | | |
|---|---|---|---|
| 3,578,499 | 5/1971 | Crotty et al. | 252/316 |
| 4,104,035 | 8/1978 | Cole et al. | 44/51 |
| 4,195,975 | 4/1980 | Hamuro et al. | 44/51 |
| 4,239,422 | 12/1980 | Clancey | 406/47 |

*Primary Examiner*—Charles F. Warren
*Assistant Examiner*—Y. Harris-Smith
*Attorney, Agent, or Firm*—Richard W. Collins

[57] ABSTRACT

Stable, pumpable slurry compositions of finely divided solid carbonaceous material in water are described. The composition includes a gelling agent to provide a supporting gel having a yield stress and a viscosity builder to reduce the bleeding of the supporting gel.

7 Claims, No Drawings

FUEL SLURRIES OF SOLID CARBONACEOUS MATERIAL IN WATER

BACKGROUND OF THE INVENTION

This invention relates to slurries of solid carbonaceous fuels in water. More particularly, it relates to such slurries which are pumpable and stable against sedimentation of the solid carbonaceous material.

There has been considerable interest recently in developing solid carbonaceous fuels such as coal and petroleum coke as a substitute for liquid hydrocarbon fuels. It has been proposed to use slurries of finely divided coke or coal suspended in fuel oil as a substitute for fuel oil. U.S. Pat. No. 4,082,516 is representative of a large body of prior art relating to fuel slurries comprised of solid carbonaceous material in liquid hydrocarbon fuel.

Similarly, there has been considerable activity in development of water-in-oil emulsions which are capable of carrying suspended solid fuel particles. U.S. Pat. No. 4,162,143 is representative of this approach.

Preparation of a solid fuel-water slurry suitable for use as a feed to a synthesis gas process is described in U.S. Pat. No. 4,104,035.

A solid fuel-water slurry having improved pumpability is described in U.S. Pat. No. 4,088,453.

Efforts to develop highly loaded, stable, pumpable coal slurries containing up to 70 percent by weight coal in water are described in an article by R. S. Schefflee entitled "Development and Evaluation of Highly Loaded Coal Slurries" published in May of 1978 in *Proceedings of the First International Symposium on Coal-Oil Mixture Combustion*, pp. 222–232. This article describes results of various carrier materials including Xanthan gum, modified corn starch, carboxymethyl cellulose and numerous related materials. An article by R. S. Shefflee and E. T. McHale entitled "Development and Evaluation of Highly Loaded Coal Slurries" published in November of 1979 in *Proceedings of the Second International Symposium on Coal-Oil Mixture Combustion*, pp. 1–6, also discusses results of a program to develop highly loaded coal-water slurry fuels. This article suggests that the best carrier is hydroxypropylated cornstarch.

Many existing marine boilers do not have the capability for recirculating or agitating fuel. This has resulted in a reluctance on the part of operators of such vessels to use solid fuel-water slurries, for fear of settling of solids from the slurries with resultant serious operating problems. Even though the prior art has reported some success in stabilizing solid fuel-water slurries by using various viscosity builders and gelling agents, there has been a continuing need for improved stabilization of such slurries.

It is accordingly an object of this invention to provide slurry fuels comprised of solid carbonaceous material in water which have a high stability against sedimentation of the solid material during storage.

SUMMARY OF THE INVENTION

Highly loaded solid fuel-water slurries are stabilized against sedimentation by combining the effects of a gelling agent and a viscosity builder.

DESCRIPTION OF THE PREFERRED EMBODIMENT

According to this invention, highly loaded, stable solid fuel-water slurries are provided by adding a gelling agent to the water phase in an amount sufficient to provide a yield stress capable of supporting the solid particles and also adding to the water phase a viscosity builder in an amount sufficient to prevent or substantially reduce bleeding of water from the gel structure. The article by Shefflee discussed above recognizes that materials such as Xanthan gum provide slurries with a yield stress. However, even with a gelling agent such as Xanthan gum, solid fuel-water slurries tend to settle at an unsatisfactory rate. This occurs in spite of the fact that the gel has a yield stress sufficiently high to support the solid fuel particles. It is believed that this settling from the gel is a result of bleeding of the gel. As the bleeding occurs, water seeps from the gel structure and moves from below a suspended particle to above a suspended particle, and the particle settles accordingly. This process takes place even though the supporting gel has a sufficient yield stress to theoretically prevent any settling.

It has now been discovered that bleeding of the supporting gel can be prevented or substantially reduced by addition of a water soluble viscosity builder to the water phase of the slurry composition, providing a synergistic effect producing a slurry which exhibits greatly reduced sedimentation settling.

The combination of a water-dispersable gelling agent and a water soluble viscosity builder has a synergistic effect upon stabilization of solid fuel-water slurries against sedimentation. While both gelling agents and viscosity builders have been utilized separately in the prior art for stabilizing solid fuel-water slurries, long-term stability has not been previously obtained. The combination of materials according to this invention provides results not obtainable simply by using more of one or the other of the materials, and while the mechanism of the enhanced stability is not known for certain, it is believed to be due to the effect of the viscosity builder in reducing the internal bleeding of the gel formed by the water-dispersable gelling agent.

Any material capable of providing the water phase with a yield stress may be used as the gelling agent. The gelling agent should be water dispersable, and preferably is a biopolymer such as Xanthan gum, which is the preferred material of this invention. Xanthan gum is a high molecular weight natural polysaccharide which is produced in a fermentation process by the microorganism *Xanthomonas campestris*. Xanthan gums are produced commercially by several manufacturers and are readily available.

The viscosity builders useful in this invention are water-soluble materials such as cellulose derivatives and starch derivatives. The most preferred material is sodium carboxymethyl cellulose. Other preferred materials are hydroxypropylated cornstarch, hydroxyethyl cellulose, hydroxypropyl methyl cellulose and methyl cellulose. Many other water soluble viscosity builders such as polyethylene glycol and polypropylene glycol are known and readily available which increase the viscosity of water when added in very small amounts such as from one tenth to one percent by weight of the water.

Slurries to which the present invention is applicable are highly loaded solid fuel in water compositions. At least 40 percent by weight of the slurry must be solid fuel. Preferably, from 60–70 percent by weight of the slurry is solid fuel, and it may be possible in some cases to have a pumpable slurry which includes as much as 75 percent by weight of solid material. The ultimate amount of solid material which can be used is a function of the particle size distribution of the solid material as well as the type and amount of stabilizing additives and the conditions under which the slurry is to be used. Preferably, a substantial amount, such as 90 percent, of the solid material should pass through a 60-mesh sieve (Tyler Standard Sieve Series), and most preferably, at least 80 percent of the solid material should pass through a 100- mesh sieve.

The solid fuel material can be any of the conventional materials used for this purpose including coal, lignite, petroleum coke and the like. Preferably, as the slurries are particularly suitable for use in marine boilers, a low ash material such as de-ashed coal or petroleum coke is used.

The amount of the gelling agent should be sufficient to provide a supporting gel having a yield stress sufficient to support the solid material in the slurry. For Xanthan gum, an amount of from 0.1 to 1.0 percent by weight of the water phase is generally sufficient, and about 0.2 to 0.3 is generally the optimum amount.

The amount of viscosity builder required depends on the particular material used, the degree of stabilization desired, and other factors. The amount must be sufficient to substantially reduce the internal bleeding of the supporting gel, but must be less than the amount which would render the resulting slurry unpumpable. From about 0.1 to 1.0 percent by weight of the water phase is generally preferred for sodium carboxymethyl cellulose, and a similar amount is appropriate for most of the useful viscosity builders.

Preparation of the slurries for this invention preferably involves addition of a small amount, such as one-tenth of one percent by weight of the water phase, of a wetting agent. Many commercial wetting agents are available which are satisfactory if used in an amount sufficient to enable wetting of the solid particles by the aqueous phase.

To illustrate the improved sedimentation stability obtained by this invention, two slurries comprising 60 percent by weight -100 mesh petroleum coke were prepared. For one of the slurries, the aqueous carrier consisted of 0.1 weight percent wetting agent and 0.5 weight percent Xanthan gum. For the other slurry, the aqueous carrier consisted of 0.1 weight percent wetting agent, 0.5 weight percent Xanthan gum and 1.0 weight percent sodium carboxymethyl cellulose. The two slurries were identical except for the addition of 1.0 percent sodium carboxymethyl cellulose to the second slurry. After six weeks of static storage at room temperature, the first slurry had approximately one centimeter of soft sediment on the bottom of the container. The second slurry containing the sodium carboxymethyl cellulose had no visually detectable sediment.

We claim:

1. A stable, pumpable slurry composition of finely divided solid carbonaceous material in water wherein said slurry comprises:

(a) at least 40 percent by weight of finely divided solid carbonaceous material;

(b) water in an amount sufficient to provide a pumpable slurry;

(c) a sufficient amount of a wetting agent in said water to effect wetting of the surface of said carbonaceous material;

(d) water-dispersible Xanthan gum in said water in an amount sufficient to provide a supporting gel having a yield stress sufficient to support said carbonaceous material in said slurry; and (e) a water-soluble viscosity builder selected from the group consisting of sodium carboxymethyl cellulose, hydroxypropylated cornstarch, hydroxyethyl cellulose, hydroxypropyl methyl cellulose and methyl cellulose in said water in an amount sufficient to substantially reduce bleeding of the supporting gel, whereby said slurry is stabilized against sedimentation caused by bleeding of the supporting gel.

2. The composition of claim 1 wherein said carbonaceous material is present in an amount of from 60 to 70 percent by weight and at least 90 percent thereof will pass through a 60-mesh sieve.

3. The composition of claim 2 wherein said carbonaceous material is coal.

4. The composition of claim 2 wherein said carbonaceous material is a petroleum coke.

5. The composition of claim 2 wherein said Xanthan gum is present in an amount of from 0.1 to 1.0 percent by weight of the water in said slurry.

6. The composition of claim 5 wherein said viscosity builder is sodium carboxymethyl cellulose in an amount of from 0.1 to 1.0 percent by weight of the water in said slurry.

7. The composition of claim 6 wherein at least 80 percent of said carbonaceous material will pass through a 100-mesh sieve.

* * * * *